US006554059B2

(12) United States Patent
Hata et al.

(10) Patent No.: US 6,554,059 B2
(45) Date of Patent: Apr. 29, 2003

(54) CEILING EMBEDDED TYPE INDOOR UNIT

(75) Inventors: Yoshiki Hata, Shimizu (JP); Takashi Sano, Shimizu (JP); Shinichi Kosugi, Shimizu (JP)

(73) Assignee: Hitachi, Ltd., Tokyo (JP)

( * ) Notice: Subject to any disclaimer, the term of this patent is extended or adjusted under 35 U.S.C. 154(b) by 6 days.

(21) Appl. No.: 09/901,107

(22) Filed: Jul. 10, 2001

(65) Prior Publication Data

US 2001/0037874 A1 Nov. 8, 2001

Related U.S. Application Data

(63) Continuation of application No. 09/461,731, filed on Dec. 16, 1999, now Pat. No. 6,345,667.

(30) Foreign Application Priority Data

Dec. 18, 1998 (JP) ..... 10-360216

(51) Int. Cl.[7] ..... F24D 19/02
(52) U.S. Cl. ..... 165/53; 165/122; 165/150
(58) Field of Search ..... 165/53, 54, 150, 165/122

(56) References Cited

U.S. PATENT DOCUMENTS

| | | | | |
|---|---|---|---|---|
| 4,677,279 A | | 6/1987 | Wesseltoft | |
| 4,854,375 A | | 8/1989 | Farina et al. | |
| 5,884,500 A | | 3/1999 | Wetzel | |
| 5,884,694 A | * | 3/1999 | Tanenbaum | 165/53 |

FOREIGN PATENT DOCUMENTS

| | | | | |
|---|---|---|---|---|
| DE | 9512275 | * | 9/1996 | 165/53 |
| JP | 5535872 | | 3/1980 | |
| JP | 0149536 | * | 11/1981 | 165/53 |
| JP | 60169031 | | 9/1985 | |
| JP | 2194128 | * | 8/1987 | 165/53 |
| JP | 3123929 | * | 8/1988 | 165/53 |
| JP | 63279046 | | 11/1988 | |
| JP | 6419237 | | 1/1989 | |
| JP | 1217141 | * | 8/1989 | 165/53 |
| JP | 432648 | | 2/1992 | |
| JP | 5106856 | | 4/1993 | |
| JP | 5172361 | * | 7/1993 | 115/53 |
| JP | 10141708 | | 5/1998 | |
| JP | 11148711 | | 6/1999 | |

* cited by examiner

*Primary Examiner*—Christopher Atkinson
(74) *Attorney, Agent, or Firm*—Antonelli, Terry, Stout & Kraus, LLP

(57) ABSTRACT

In a ceiling embedded type indoor unit for an air conditioner, an wind sound is reduced while preventing a beat sound of blowers with keeping a high air conditioning capacity. In the ceiling embedded type indoor unit provided with a U-shaped heat exchanger which is placed in a casing embedded in a ceiling and is constituted by two side portions and a bottom portion connecting the side portions at one end side, blowers arranged in an inner space of the heat exchanger, a decorative panel mounted to a lower surface of the casing and having two elongated air outlet ports in correspondence to the side portions of the heat exchanger and an air suction port formed between the air outlet ports, and a control apparatus, the control apparatus controls so that the number of rotation of the blower near a valley portion of the U-shaped heat exchanger becomes high and the number of rotation of the blower near the open end of the U-shaped heat exchanger becomes low.

4 Claims, 15 Drawing Sheets

CEILING EMBEDDED TYPE INDOOR UNIT

This is a continuation of parent application Ser. No. 09/461,731, filed Dec. 16, 1999 now U.S. Pat. No. 6,345, 667.

BACKGROUND OF THE INVENTION

The present invention relates to an indoor unit for an air conditioner and particularly to a ceiling embedded type indoor unit in which a U-shaped or C-shaped heat exchanger is provided and a blower is provided in an inner space formed by the heat exchanger.

In a ceiling embedded indoor unit having four air outlet ports respectively facing four directions and a plurality of centrifugal blowers arranged side by side, structure is known in which a heat exchanger formed in a rectangle shape or two heat exchangers formed in L-shape are arranged so as to surround the centrifugal blowers, and the blowers arranged in the same level. However, in a ceiling embedded indoor unit having two air outlet ports facing opposite directions, such structure is not known.

Further, in controlling a number of rotation of a plurality of blowers, an embodiment in which a number of rotation of a certain blower is fixed and a number of rotation of another blower is variable is present in an outdoor unit, however, is not present in an indoor unit.

It is required that a height of the ceiling embedded type (regardless of four directions blowing-out type or two directions blowing-out type) indoor unit for the air conditioner is set to be as small as possible so that the indoor unit can be placed even in a portion in which a depth of the ceiling is small (for example, 300 mm or less). In order to technically limit a height of the indoor unit to a low level, it is a problem how a height of the heat exchanger which is an element of the indoor unit is made small. Since an area of the heat exchanger is naturally reduced as the height of the heat exchanger is reduced, it is necessary to make a length of the heat exchanger longer correspondingly.

Particularly, in the indoor until having a large capacity of about 10 kW or more, since it is impossible to increase a width of a casing of the indoor unit due to a limitation for execution, a rectangular casing is frequently employed. In the case of using the rectangular type or U-shape heat exchanger in this casing, the heat exchanger becomes necessarily rectangular, so that a wind velocity balance with respect to the heat exchanger is deteriorated if only one centrifugal blower of which axis is arranged vertically is used. Therefore, a plurality of blowers must be employed.

In this case, in the prior art ceiling embedded indoor unit having four air outlet ports, since the rectangular heat exchanger or the combination of the L-shaped heat exchangers is employed so as to substantially uniformly surround the periphery of the blowers, the wind velocity balance with respect to the heat exchanger becomes substantially uniform even when the numbers of rotation of a plurality of blowers are equal to each other.

However, in the ceiling embedded type two directions blowing-out type indoor unit, in the case of employing the rectangular heat exchanger or the combination of the L-shaped heat exchangers, there are two sides of the heat exchanger which are not positioned at outlet ports, so that it is disadvantageous in view of a cost. Further, in the case of arranging the heat exchanger only in the portion positioned at the outlet ports, two heat exchangers are needed and two refrigerant distributing devices are required. This is disadvantageous in view of a cost.

Accordingly, in the two directions blowing-out type indoor unit, a U-shaped heat exchanger is most suitable in view of a cost. However, in the case of using a plurality of blowers as mentioned above, since the areas of the heat exchanger to which an air discharged from each of the blowers applies are different from each other, the wind velocity balance with respect to the heat exchanger is not uniform. As a result, a problem is expected that an air conditioning capacity is deteriorated and a wind sound is increased.

Further, when the plurality of blowers are operated at the numbers of rotation close to each other, frequency band areas which generate high noise become close to each other. Therefore, a problem also is expected that a beat sound is likely to occur.

Further, when an interval between an inner peripheral surface of the heat exchanger and an outer peripheral surface of an impeller becomes small in order to make the air conditioner compact, an air current at a high velocity blown out from the impeller collides with fins of the heat exchanger in a downstream side of a position at which the heat exchanger and the impeller most approach to each other, whereby a wind sound is generated.

An object of the present invention is to provide a ceiling embedded type indoor unit which can reduce an air passing sound while preventing a beat sound of blowers with setting a wind velocity balance with respect to a heat exchanger uniform and keeping a high air conditioning capacity, in order to restrict a product height and a cost to a low level, even when a plurality of blowers and a U-shaped heat exchanger are used.

Further, another object of the present invention is to provide a ceiling embedded type indoor unit which can secure a long peripheral length of a heat exchanger within a limited space and making a wind velocity with respect to the heat exchanger uniform so as to increase an amount of heat exchange, as a result a compact size can be achieved although the problem as to the cost increase due to employing a plurality of heat exchangers cannot be solved.

Other object of the present invention is to provide an air conditioner preferable for making compact and reducing noise.

In this case, the present invention solves at least one of the problems mentioned above.

SUMMARY OF THE INVENTION

In order to achieve the objects mentioned above, in accordance with a first aspect of the present invention, there is provided a ceiling embedded type indoor unit comprising: a casing embedded in a ceiling; a U-shaped heat exchanger placed within the casing, constituted by two side portions and a bottom portion connecting these side portions in one end side, and the side portions and the bottom portion being arranged in a horizontal direction; a plurality of blowers arranged side by side from the bottom portion of the U-shaped heat exchanger to an open end side of the U-shaped heat exchanger in an inner space of the heat exchanger; a plurality of motors of which upper ends are fixed to ceiling side of the casing, the blowers being mounted on rotary shafts provided at the lower ends of the motors; a decorative panel mounted on a lower surface of the casing and having two long air outlet ports in correspondence to the side portions of the U-shaped heat exchanger and an air suction port formed between the air outlet ports; and a control apparatus placed within the casing, wherein the control apparatus controls so that the number of rotation of the blower near a valley portion of the U-shaped heat exchanger becomes high and the number of rotation of the blower near the open end of the U-shaped heat exchanger becomes low. With this control, the wind velocity balance with respect to the U-shaped heat exchanger can be close to a uniform value.

Further, in accordance with a second aspect of the present invention, a ceiling embedded type indoor unit is structured such that a control apparatus controls a number of rotation of the blower close to the open end of the U-shaped heat exchanger to be fixed, controls a number of rotation of the blower close to the valley portion of the U-shaped heat exchanger to be variable, and controls a maximum number of rotation of the blower close to the valley portion of the U-shaped heat exchanger to be higher than the fixed number of rotation of the blower close to the open end of the U-shaped heat exchanger. Since these control circuits are expensive, it is possible to reduce a capacity of the control apparatus by fixing the number of rotation of a certain blower, so that the cost can be reduced.

In the ceiling embedded type indoor unit in accordance with the second aspect, in the case of operating the blower having a variable number of rotation near a wind amount 0 at the lowest wind amount, it is preferable that the control apparatus is structured such as to operate the blower having the variable number of rotation at a number of rotation capable of preventing the discharged air from the blower of the fixed number of rotation from short-circuiting. Further, in order to accurately detect a suction air temperature, it is preferable to place a suction air temperature sensor near the blower having the fixed number of rotation.

Further, in accordance with a third aspect of the present invention, a control apparatus of a ceiling embedded type indoor unit is structured such as to variably control a number of rotation of the blower close to the valley portion of the U-shaped heat exchanger to be higher, controls a number of rotation of the blower close to the open end of the U-shaped heat exchanger to be lower, and controls a ratio between the numbers of rotation of both of the blowers to be fixed. Due to the control mentioned above, it is possible to make the wind velocity balance with respect to the heat exchanger nearly uniform even in the case of switching a wind amount among a sudden wind, a strong wind, a weak wind and the like.

In the ceiling embedded type indoor unit in accordance with the third aspect, in order to accurately detect a suction air temperature, it is preferable to place a suction air temperature sensor near the blower having the high number of rotation.

Further, in the ceiling embedded type indoor unit mentioned above, it is preferable to be structured such that an outlet air temperature sensor is provided, the control apparatus stores an outlet air temperature previously determined on the basis a number of rotation in each of the blowers, a suction air temperature and temperatures of a gas refrigerant and a liquid refrigerant which flow into and out of the heat exchanger, as data, calculates the outlet air temperature on the basis of detected values of the number of rotation in each of the blowers, the suction air temperature, the gas refrigerant temperature and the liquid refrigerant temperature with reference to the data, and outputs the outlet air temperature to the outlet air temperature sensor. Accordingly, even when the wind amount is changed, the outlet air temperature sensor indicates a value close to an average temperature of a whole of the outlet port.

Further, in accordance with a fourth aspect of the present invention, the ceiling embedded type indoor unit is characterized in that positions of a plurality of blowers are vertically shifted. Accordingly, an interference of the air discharged from the adjacent blowers is reduced.

In accordance with a fifth aspect of the present invention, the ceiling embedded type indoor unit is structured such that the heat exchangers are constituted by C-shaped heat exchangers which surround most of peripheries of the blowers. By making the structure in the manner mentioned above, it is possible to set a peripheral length of the heat exchanger long and make a wind velocity distribution nearly uniform.

Further, in accordance with the present invention, it is desirable that the heat exchanger mentioned above is structured such that rectifying plates which protrude inward from an inner peripheral surface of the heat exchanger so as to correspond to at least a height of outlets of the impellers are provided in downward side of the air flow discharged from the impellers at positions at which the inner peripheral surfaces of the heat exchangers and outer peripheral surfaces of the impellers are in the closest vicinity to each other.

DESCRIPTION OF PREFERRED EMBODIMENTS

A ceiling embedded type indoor unit in accordance with the present invention will be concretely described hereinafter.

Figure 8:
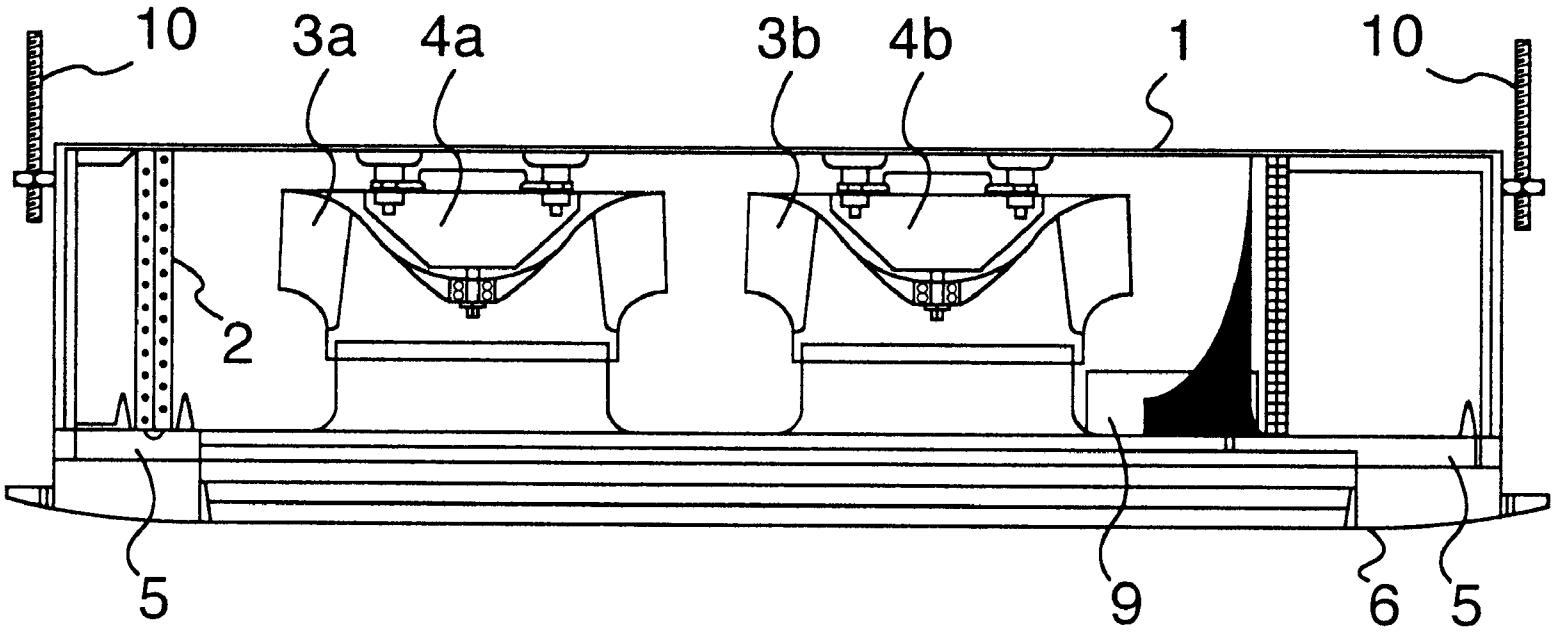
FIG. 8 is a side elevational view showing a basic structure of a ceiling embedded type indoor unit in accordance with the present invention.

At first, FIG. 8 shows a basic structure of a ceiling embedded type indoor unit of an air conditioner in accordance with the present invention, which has two air outlet ports and is called as a two-direction outlet indoor unit. This embodiment corresponds to an embodiment employing two blowers.

This indoor unit comprises a casing 1 which is embedded in a ceiling (not shown), a U-shaped heat exchanger 2 which is placed within the casing, blowers 3*a* and 3*b* which are arranged side by side in a vertical direction of the U shape in an inner space of the U-shaped heat exchanger 2, motors 4*a* and 4*b* which drive the blowers 3*a* and 3*b*, a decorative panel 6 which is mounted on an open portion of a lower surface of the casing 1 and has an air suction port and an air outlet ports, and an electric parts box 9 which receives a control apparatus. In addition, a water receiver 5 is provided within the casing 1. The indoor unit is suspended from the ceiling via suspending bolts 10 and is mounted.

Figure 9:
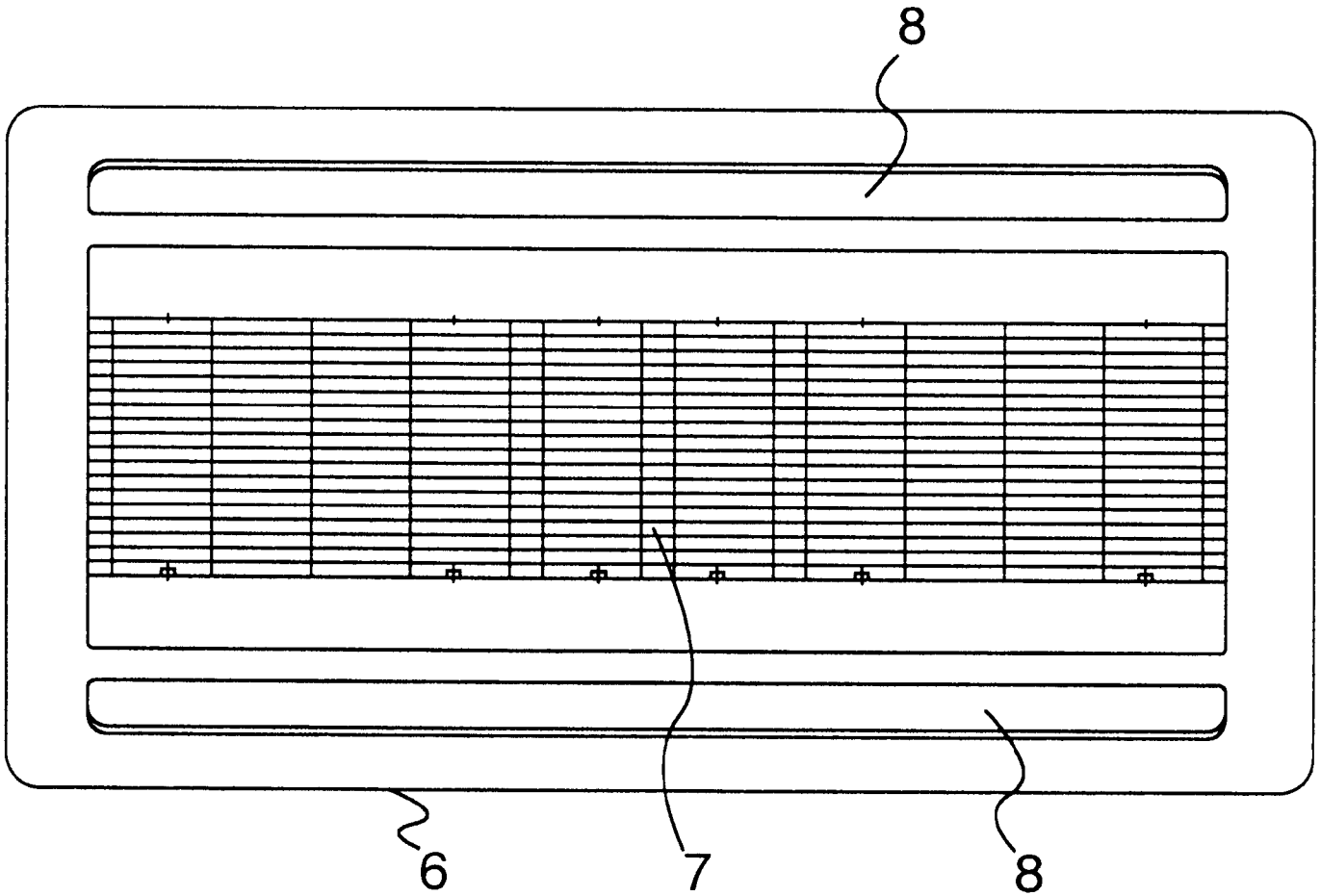
FIG. 9 is a front view of a two-direction outlet decorative panel mounted to a lower surface of a ceiling embedded type indoor unit in accordance with the present invention.

The U-shaped heat exchanger 2 is constituted by two side portions and a bottom portion which connects the side portions at one end, and the side portions and the bottom portion are arranged in a horizontal direction. The blowers 3*a* and 3*b* are arranged at a position close to the bottom portion in the inner space of the U-shaped heat exchanger 2 and a position close to the open end of the side portions. The motors 4*a* and 4*b* are fixed to a ceiling side of the casing 1 at upper ends thereof, and the blowers 3*a* and 3*b* are mounted on rotary shafts provided at lower ends thereof. The decorative panel 6 has two elongated air outlet ports 8 formed in parallel with the respective side portions of the U-shaped heat exchanger and an air suction port 7 formed between the air outlet ports 8, as shown in FIG. 9.

The two-direction outlet indoor unit corresponds to a type in which two outlet ports are provided.

FIGS. 1 to 7 show embodiments in accordance with the present invention. An embedded type indoor unit in accordance with each of the embodiments corresponds to an embodiment employing two blowers, however, three or more blowers may be employed.

Figure 1:
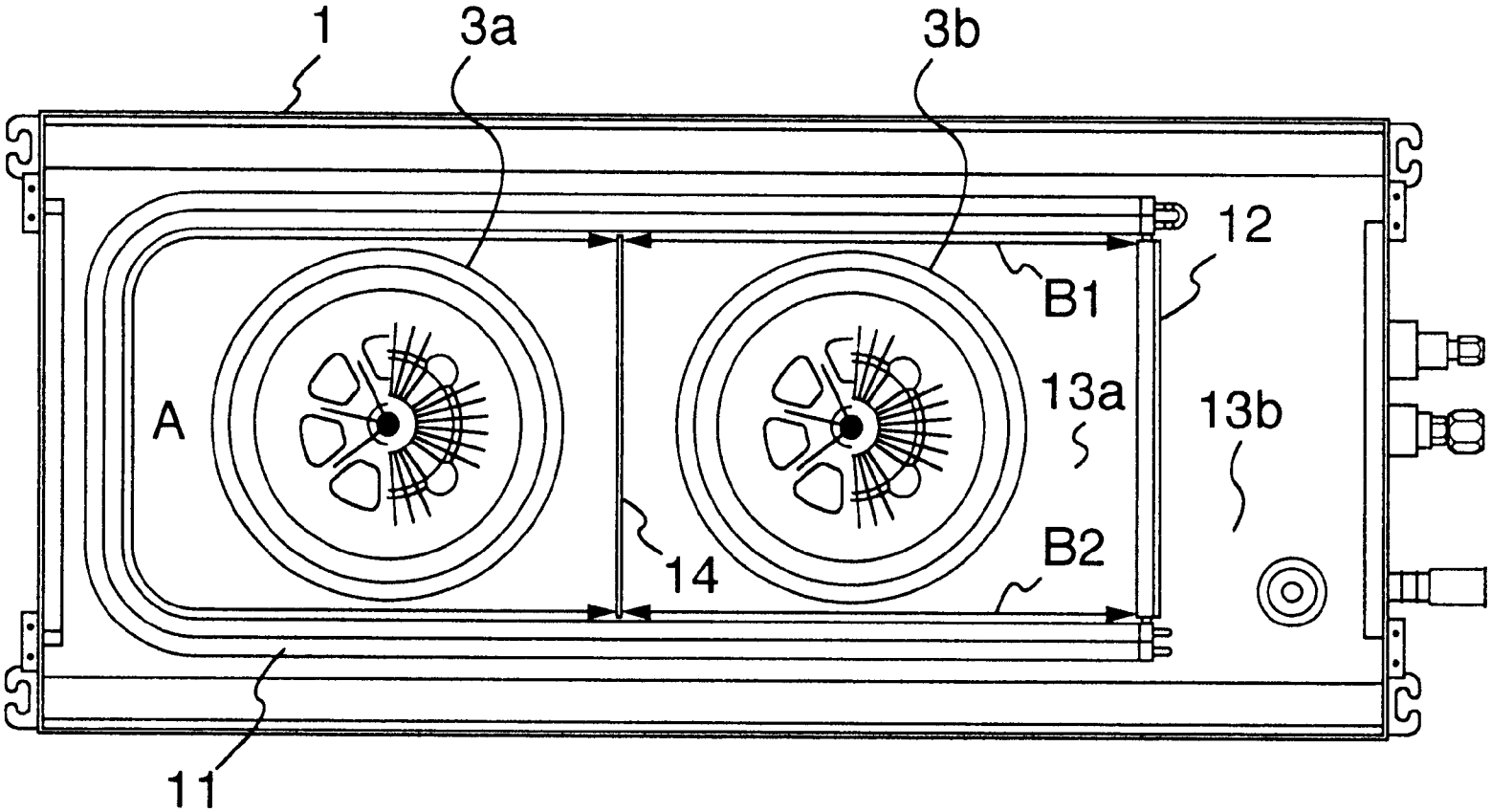
FIG. 1 is a plan view showing a structure of a ceiling embedded type indoor unit in accordance with an embodiment 1 of the present invention.

FIG. 1 shows a ceiling embedded type indoor unit in accordance with an embodiment 1 of the present invention. In the indoor unit, the blowers 3*a* and 3*b* are arranged in a center portion of the two-direction outlet type indoor unit and the U-shaped heat exchanger 11 is arranged around the blowers. A partition plate 12 is mounted to the open end of the U-shaped heat exchanger 11, and this partition plate 12 separates a primary space 13*a* corresponding to an inner portion of the U-shaped heat exchanger from a secondary space 13*b* corresponding to an outer portion thereof. The U-shaped heat exchanger is placed substantially in parallel with a longitudinal direction of the indoor unit. In this case, the U shape means that two bent portions are formed in a flat heat exchanger and a bending angle is substantially 90 degrees, thereby forming a shape of alphabet "U". In this case, in the heat exchanger 11 shown in FIG. 1, in order to prevent discharged air of the blowers 3*a* and 3*b* from interfering with each other, a partition plate 14 is placed between both blowers 3*a* and 3*b*.

In this case, surfaces of the heat exchanger to which the discharge air of the blower 3*a* is supplied are three surfaces (a portion shown by A) comprising the bottom portion of the heat exchanger and parts of the side portions continuing to both ends the bottom portion, and surfaces of the heat exchanger to which the discharge air of the blower b is supplied are two surfaces (portions shown by B1 and B2) comprising parts of the respective side portions of the heat exchanger. However, since the heat exchanger 11 is formed in the U shape, a peripheral length of the A portion is longer than a value (B1+B2). Here, if the lengths of B1 and B2 are extended, the value (B1+B2) can be made the same length as the length of the A portion. However, the heat exchanger end portion is apart from the blower 3*b* and the wind velocity is reduced, so that a heat exchanging amount is reduced. Accordingly, when the number of rotation of the blower 3*a* is increased and the number of rotation of the blower 3*b* is set to a low level in correspondence to an area ratio of the heat exchanger A: (B1+B2), the wind velocity balance with respect to the heat exchanger 11 becomes nearly uniform all around the peripheral length. That is, the indoor unit in accordance with the embodiment 1 is controlled by the control apparatus so that the numbers of rotation of both blowers 3*a* and 3*b* are made variable and the number of rotation of the blower 3*a* surrounded by the heat exchanger at three portions is set to be higher than that of the blower 3*b* surrounded at two portions.

Accordingly, if the refrigerant within the heat exchanger is in a phase changing region in which it always changes from a gas to a liquid (at a heating operation) or from a liquid to a gas (at a cooling operation), an amount of heat exchange all around the peripheral length of the exchanger 11 becomes nearly uniform and it is possible to exhibit the cooling and heating capacity of the heat exchanger at the maximum. Further, it is possible to minimize a sound generated when the discharge air passes through the heat exchanger, and it is possible to reduce an air blowing noise. Further, since the numbers of rotation of the respective blowers are different, frequency band areas for a loud noise are apart from each other, so that it is hard to generate a beat sound.

Figure 2:
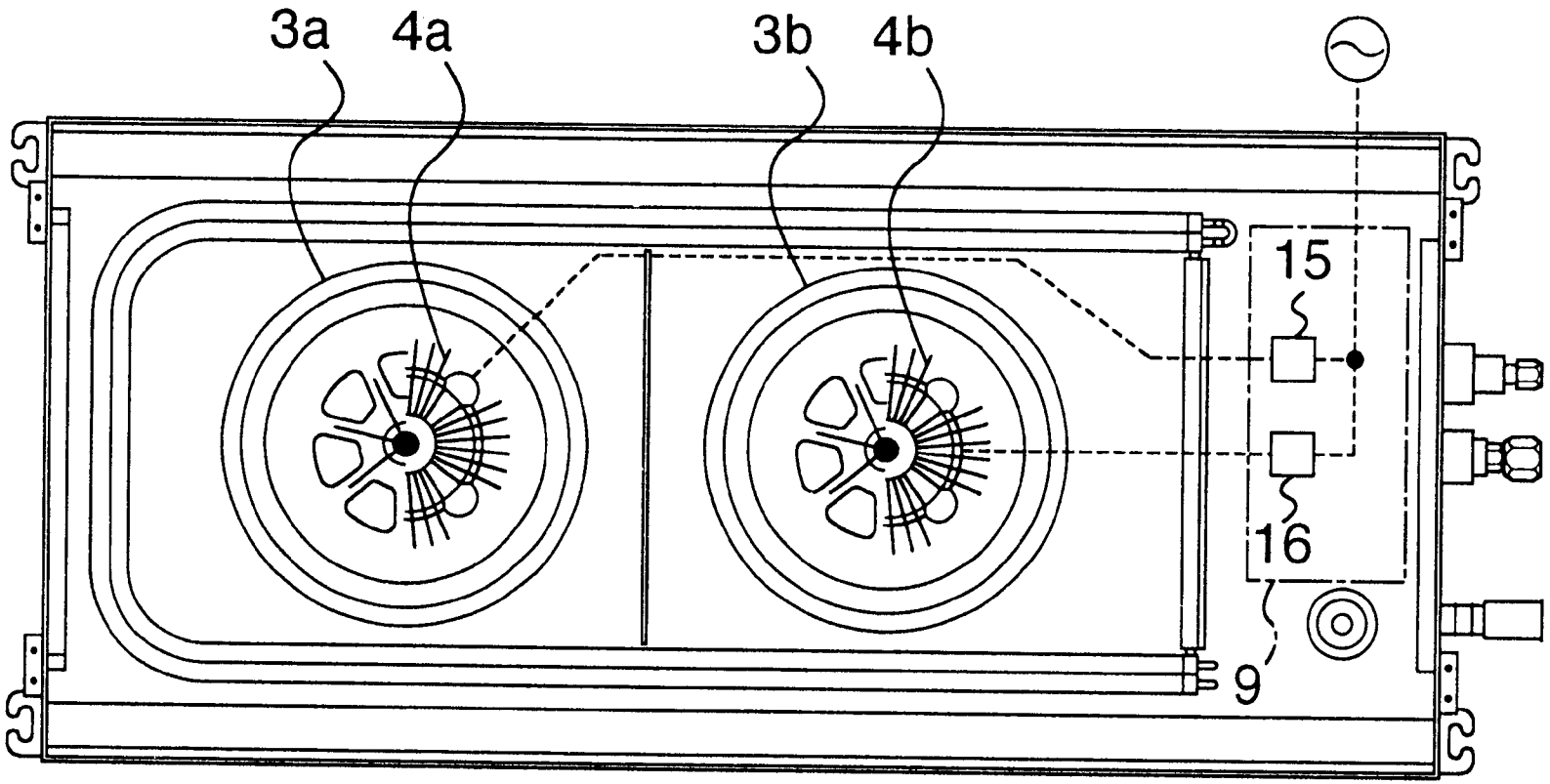
FIG. 2 is a plan view showing a structure of a ceiling embedded type indoor unit in accordance with an embodiment 2 of the present invention.

FIG. 2 is a view showing a ceiling embedded type indoor unit in accordance with an embodiment 2 of the present invention. In this indoor unit, a number of rotation of the blower 3*a* is variable, a number of rotation of the blower 3*b* is fixed, and the number of rotation of the blower 3*a* is set to be higher than that of the blower 3*b* at the maximum wind amount of the indoor unit.

Motors 4*a* and 4*b* for driving the blowers 3*a* and 3*b* are electrically connected to a power source via an electric parts box 9. The blower 3*a* has the number of rotation higher than that of the blower 3*b* at the maximum wind amount, and the motor 4*a* is connected to the power source via a rotational number control apparatus 15 installed within the electric parts box 9 and is variable. On the contrary, the motor 4*b* is connected to the power source via an ON/OFF control apparatus 16 and has a fixed number of rotation.

In this case, the rotational number control apparatus 15 has been conventionally switched by a relay circuit among a sudden wind, a strong wind, a weak wind and the like, however, in recent years, a thyristor control which can freely set the number of rotation and a PWM control such as an inverter, an AC chopper and the like have been frequently employed due to a standardization of the blower motor. However, since these are all expensive, and a current capacity is increased when being employed for a plurality of blowers, these causes a further cost.

Accordingly, when only one of the blowers is set to have a variable number of rotation and the other is set to have a fixed number or rotation, it is possible to restrict a cost of the rotational number control apparatus 15. In this case, in order to set a difference between the maximum wind amount and the minimum wind amount to a great level, it is advantageous to set the number of rotation of the blower 3*a* of the variable number of rotation higher at the maximum wind amount as in the indoor unit in accordance with the embodiment 2.

Figure 3:
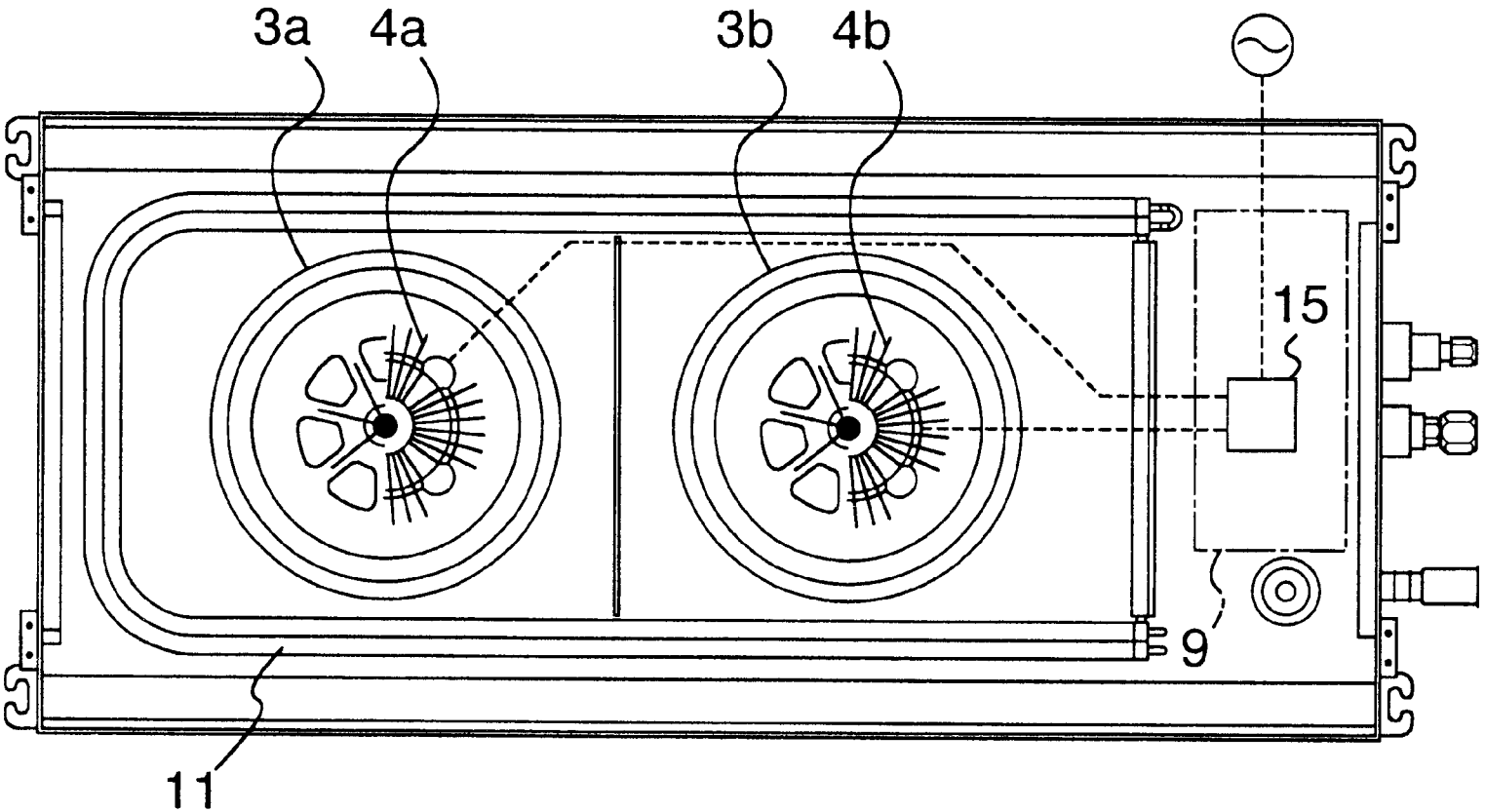
FIG. 3 is a view showing a structure of a ceiling embedded type indoor unit in accordance with an embodiment 3 of the present invention.

FIG. 3 is a view showing a ceiling embedded type indoor unit in accordance with an embodiment 3 of the present invention. In this indoor unit, numbers of rotation of both blowers 3*a* and 3*b* are variable, and a ratio between a high number of rotation of the blower 3*a* and a low number of rotation of the blower 3*b* is set to be fixed. Motors 4*a* and 4*b* for driving the blowers 3*a* and 3*b* are electrically connected to a power source via an electric parts box 9. The motors 4*a* and 4*b* are connected to the power source via a rotational number control apparatus 15 installed within the electric parts box 9 and are variable.

The blower 3*a* has a number of rotation higher than that of the blower 3*b*, and the rate of numbers of rotation between the blowers 3*a* and 3*b* becomes constant even when switching of the wind amount among a sudden wind, a strong wind, a weak wind and the like is effected. Therefore, it is possible to set the wind velocity balance with respect to the heat exchanger 1 mentioned in the embodiment 1 to be uniform all around the peripheral length even at a time of switching the wind amount and it is possible to exhibit the capacity of the heat exchanger at the maximum.

In this case, as the method of making the rate of numbers of rotation of the blowers constant even at a time of switching the wind amount, there are method in which number of rotation—torque characteristics of the blower motors 4*a* and 4*b* are previously tuned so as to satisfy the relation mentioned above, or a method in which two rotational number control apparatus 15 are provided and they are set so that rate of the numbers of rotation of the blower motors 4*a* and 4*b* becomes constant.

Figure 4:
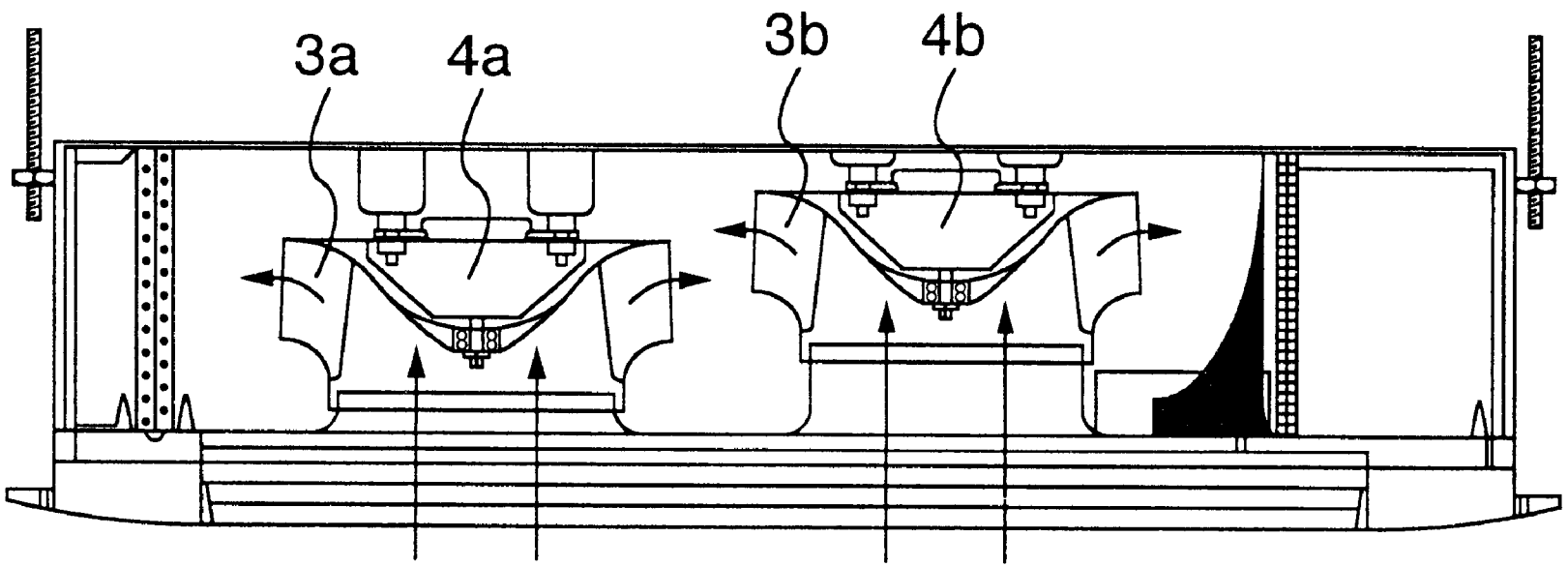
FIG. 4 is a plan view showing a structure of a ceiling embedded type indoor unit in accordance with an embodiment 4 of the present invention.

FIG. 4 is a view showing a ceiling embedded type indoor unit in accordance with an embodiment 4 of the present invention. In a structure of the ceiling embedded type two-direction outlet indoor unit shown in FIG. 8, since the blowers 3*a* and 3*b* are vertically arranged at the same level, there is a problem that the discharged air collide and interfere with each other at an intermediate portion between the blowers 3*a* and 3*b*, thereby losing the wind amount and increasing the noise.

Then, in the ceiling embedded type indoor unit shown in FIG. 4, the blowers 3*a* and 3*b* are vertically arranged at the different level, and therefore, it is possible to avoid the problems mentioned above, and it is possible to reduce a consumed power and a noise of the blower motors 4*a* and 4*b*.

Figure 5:
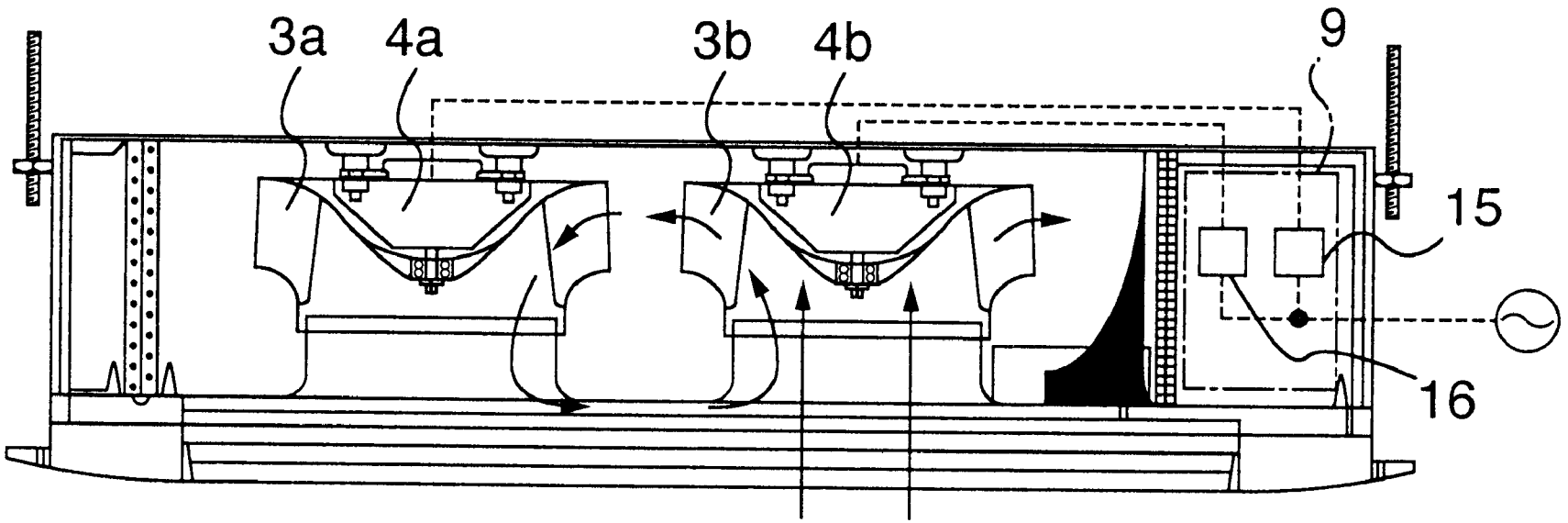
FIG. 5 is a side elevational view showing a structure of a ceiling embedded type indoor unit in accordance with an embodiment 5 of the present invention.

FIG. 5 is a view showing a ceiling embedded type indoor unit in accordance with an embodiment 5 of the present invention. The indoor unit is an improvement of the indoor unit in accordance with the embodiment 2 with respect to the minimum wind amount at a time of switching the wind amount. As in the embodiment 2, in the case of setting the blower 3*b* having a lower number of rotation to have the fixed number of rotation at the maximum wind amount and employing the rotational number control apparatus 15 only for the blower 3*a* having a higher number of rotation so as to have the variable number of rotation, in order to increase the difference between the maximum wind amount and the minimum wind amount, it is desirable to stop the blower 3*a* of the variable number of ration at the minimum wind amount. However, if the blowing is completely stopped, as shown in FIG. 5, a short circuit occurs that the discharged air of the blower 3*b* of the fixed number of rotation passes through the blower 3*a* of the variable number of rotation and returns to the blower 3*b*, so that there is a risk that the blower 3*b* performs a useless work.

Accordingly, in the indoor unit in accordance with the embodiment 5, the blower 3*a* of the variable number of rotation is slightly rotated by the rotational number control apparatus 15 even at the minimum wind amount so as to set the number of rotation to a number of rotation which does not generate a short circuit. Therefore, it is possible to obtain a low minimum wind amount while restricting the useless work of the blower 3*b* of the fixed number of rotation.

Figure 6:
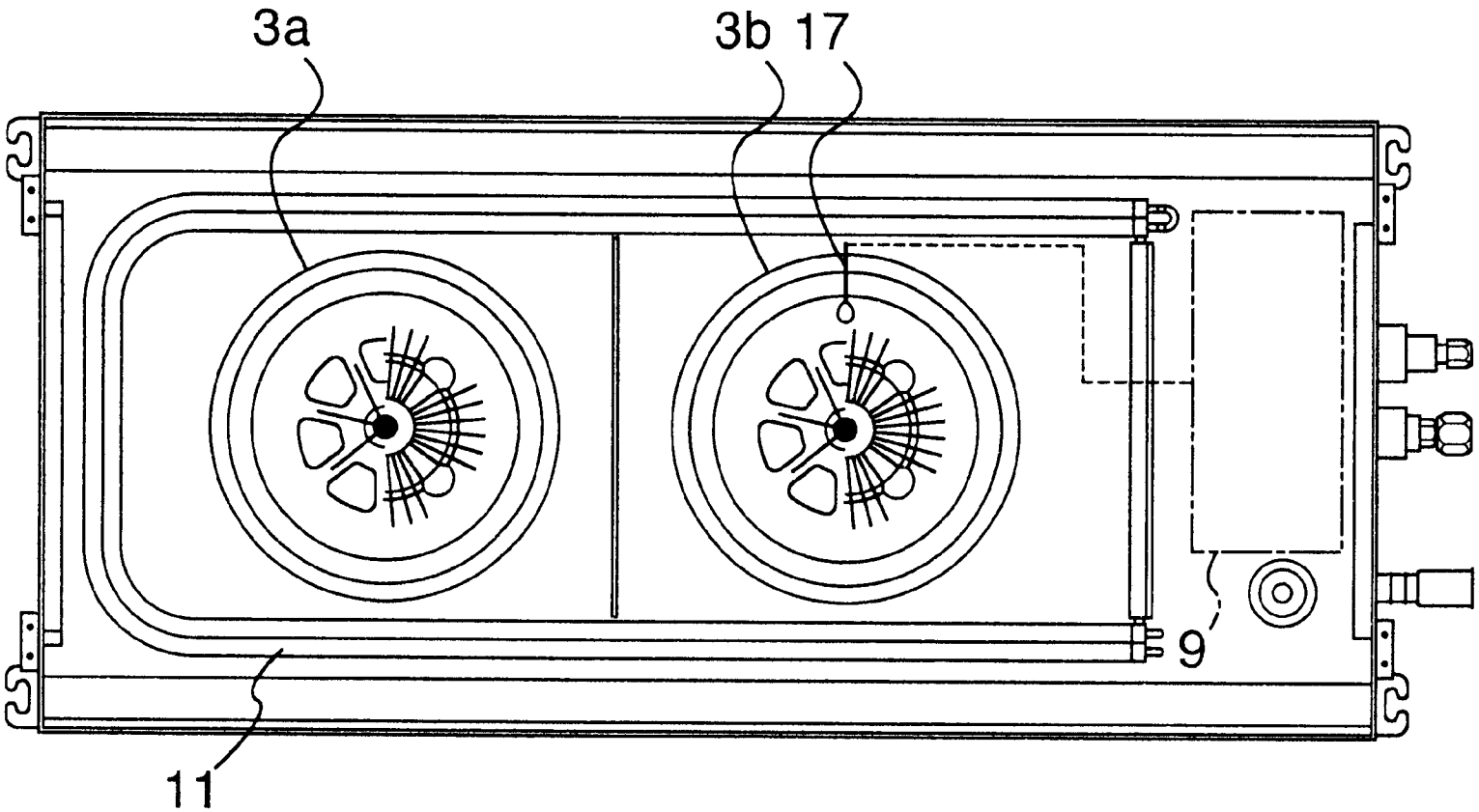
FIG. 6 is a plan view showing a structure of a ceiling embedded type indoor unit in accordance with an embodiment 6 of the present invention.

FIG. 6 is a view showing a ceiling embedded type indoor unit in accordance with an embodiment 6 of the present invention. This indoor unit is structured such that a suction air temperature sensor is added to the indoor units in accordance with the embodiments 2 and 3.

In the case that the blower 3*a* is set to have a variable number of rotation and the blower 3*b* is set to have a fixed number of rotation as in the indoor unit in accordance with the embodiment 2, a suction air temperature sensor 17 is positioned at a suction port of the blower 3*b* of the fixed number of rotation. With this, upon the minimum wind amount, a flow velocity at the suction port of the blower 3*a* of the variable number of rotation is widely reduced or becomes 0. However, the flow velocity at the suction port of the blower 3*b* of the fixed number of rotation has the same flow velocity as that at the maximum wind amount, so that the sensor 17 can detect an accurate suction air temperature.

Further, when both blowers 3*a* and 3*b* have a variable number of rotation as in the indoor unit in accordance with the embodiment 3, a more accurate suction air temperature can be detected by positioning the suction temperature sensor 17 at the suction port of the blower having the high number of rotation.

Figure 7:
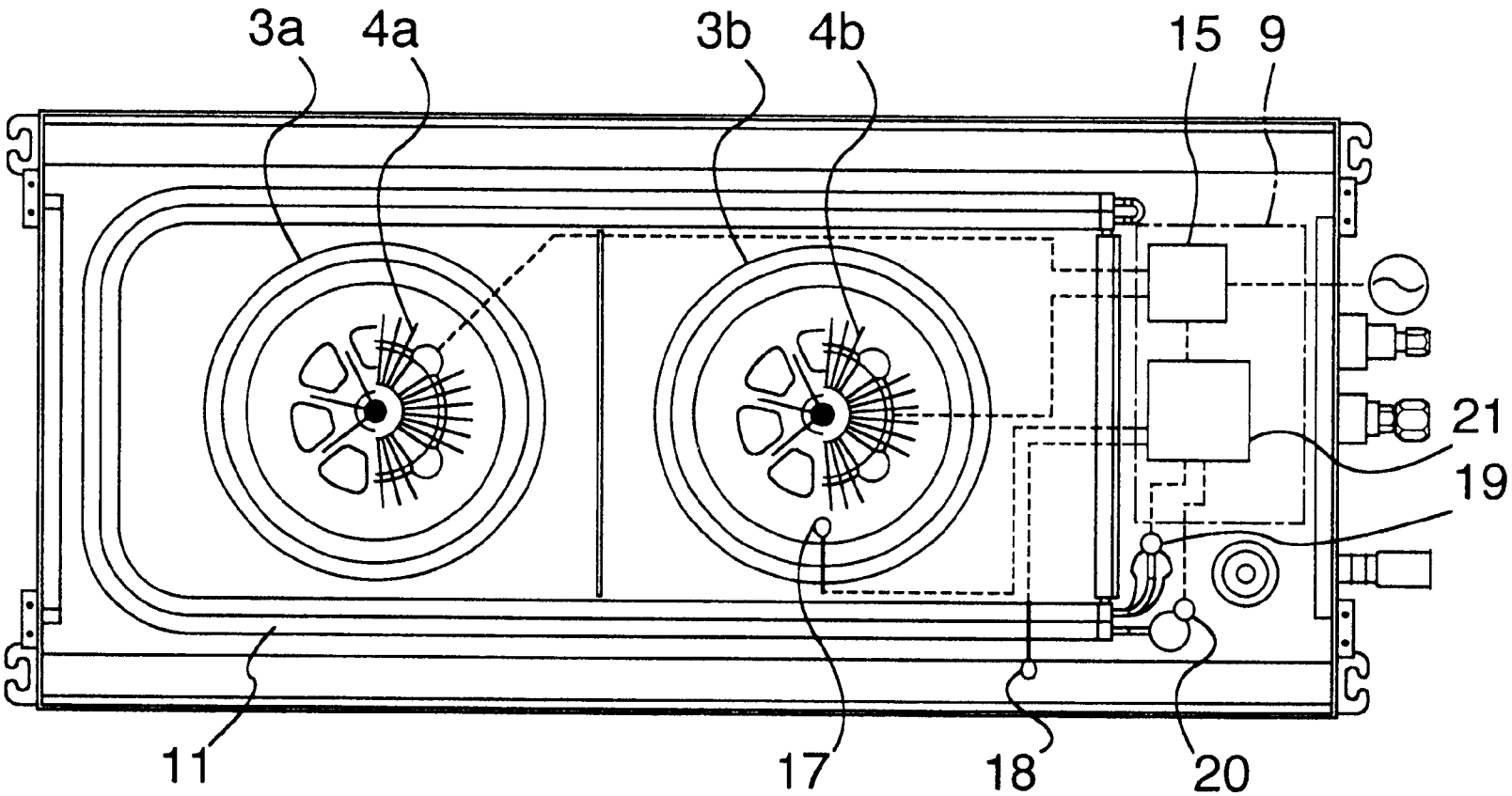
FIG. 7 is a plan view showing a structure of a ceiling embedded type indoor unit in accordance with an embodiment 7 of the present invention.

FIG. 7 is a view showing a ceiling embedded type indoor unit in accordance with an embodiment 7 of the present invention. In the indoor unit having a plurality of blowers 3*a* and 3*b* as in the present invention, when the wind amount is changed and the number of rotation of each of the blowers is changed, a wind velocity distribution with respect to the heat exchanger 11 is changed, an amount of heat exchanging is changed, and a temperature of an air downstream the heat exchanger 11 is changed, so that there is a risk that a outlet air temperature sensor 18 cannot detect an accurate temperature against an average temperature of the outlet air of the outlet port 8.

The average temperature of the outlet air and the outlet air temperature by the sensor 18 are determined in accordance with the wind amount of each of the blowers, that is, the number of rotation of each of the blowers, the suction air temperature and the state of the refrigerant cycle.

In the indoor unit in accordance with the embodiment 7, the temperature sensor 17 is placed at the air suction port, and temperature sensors 19 and 20 are placed at a refrigerant inlet port and a refrigerant outlet port of the heat exchanger 11, in order to detect the refrigerant cycle state. In this case, the temperature sensor 19 comprises a refrigerant liquid temperature sensor and the temperature sensor 20 comprises a refrigerant gas temperature sensor. Then, the detected value of the suction air temperature sensor 17 and the detected values of the refrigerant liquid temperature sensor 19 and the refrigerant gas temperature sensor 20 are taken into a control apparatus 21 of the air conditioner, the numbers of rotation of the blowers 3*a* and 3*b* are determined on the basis of these input factors, and a control is performed by the rotational number control apparatus 15.

A relation between the input factors and the numbers of rotation of the respective blowers is previously calculated in a range where the input factors may be generated, in accordance with tests, cycle state forecasting calculations and the like. Moreover, the input factors are not limited to the items mentioned above, and when a pressure in a high pressure side of the refrigerant cycle, a pressure in a low pressure side, a refrigerant circulating amount and the like are added, an accuracy can be further improved.

Accordingly, even in the case where the wind amount is changed and the number of rotation of each of the blowers is changed, the outlet air temperature sensor 18 can detect an accurate temperature against the average temperature of the outlet air at the outlet port 8.

A ceiling embedded type indoor unit in accordance with an embodiment 8 of the present invention will be described hereinafter with reference to FIGS. 10 to 13.

Figure 10:
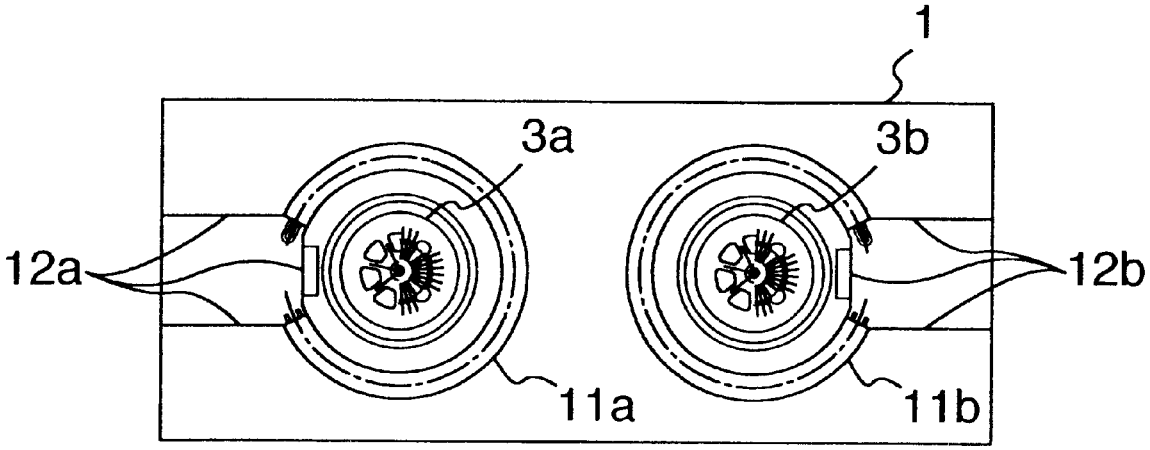
FIG. 10 is a plan view showing a structure of a ceiling embedded type indoor unit in accordance with an embodiment 7 of the present invention.

An indoor unit in accordance with the embodiment 8 is structured such that the same number of heat exchangers 11*a* and 11*b* as the number of a plurality of centrifugal type blowers 3*a* and 3*b* are arranged so as to surround the periphery of each of the blowers, as shown in FIG. 10. The heat exchanger is structured so as to form a C shape having the same center as the center of the blower. There is an advantage that the peripheral length of the heat exchanger can be set to be longer than that of the combination of two L-shaped heat exchangers or the rectangular heat exchanger in the case of the same casing size. Further, since the shape is concentrically formed with the blower, the air discharged from the blower 3*a* or 3*b* collides with the heat exchanger at a uniform wind velocity. Therefore, it is possible to improve a heat exchanging rate. Accordingly, in the case of the same casing size, in accordance with the present invention, it is possible to obtain a lot of heat exchanging amount, so that it is possible to make the casing of the indoor unit compact. Further, in the embodiment shown in FIG. 10, two C-shaped heat exchangers are placed so as to direct the open sides of the C outward with each other.

Figure 11:
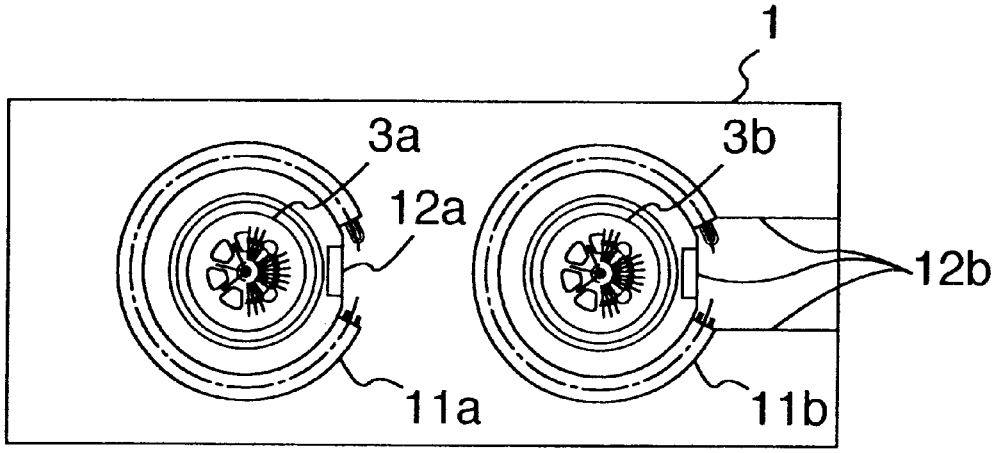
FIG. 11 is a plan view showing a modified embodiment of the embodiment 7 of the present invention.
Figure 12:
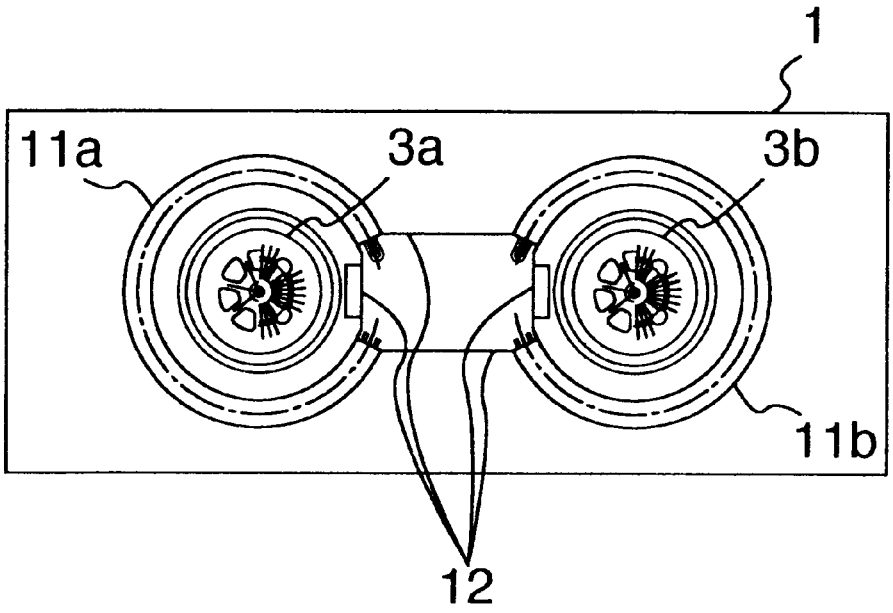
FIG. 12 is a plan view showing another modified embodiment of the embodiment 7 of the present invention.

FIGS. 11 and 12 show embodiments in which the direction of the C-shaped heat exchangers shown in FIG. 10 are modified. In the embodiment shown in FIG. 11, the open sides of the C are directed to the same direction and in the embodiment shown in FIG. 12, the open sides of the C are opposed to each other. The direction of the C-shaped heat exchangers may be suitably selected in dependent upon an arrangement of piping coming out of the exchangers.

Figure 13:
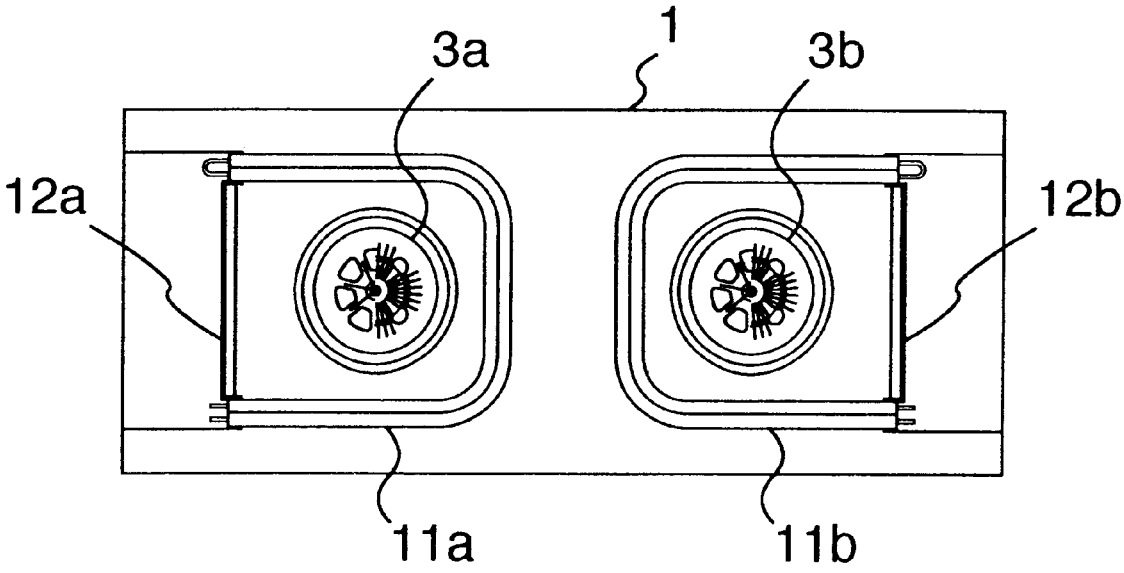
FIG. 13 is a plan view showing the other modified embodiment of the embodiment 7 of the present invention.

FIG. 13 shows an embodiment in which the C-shaped heat exchanger is replaced by a U-shaped heat exchanger, and this embodiment is worse than the C-shaped heat exchanger in view of a peripheral length and a uniformity of a wind velocity distribution. However, this embodiment may be selected in the case that a production equipment for the heat exchanger is limited.

Figure 14:
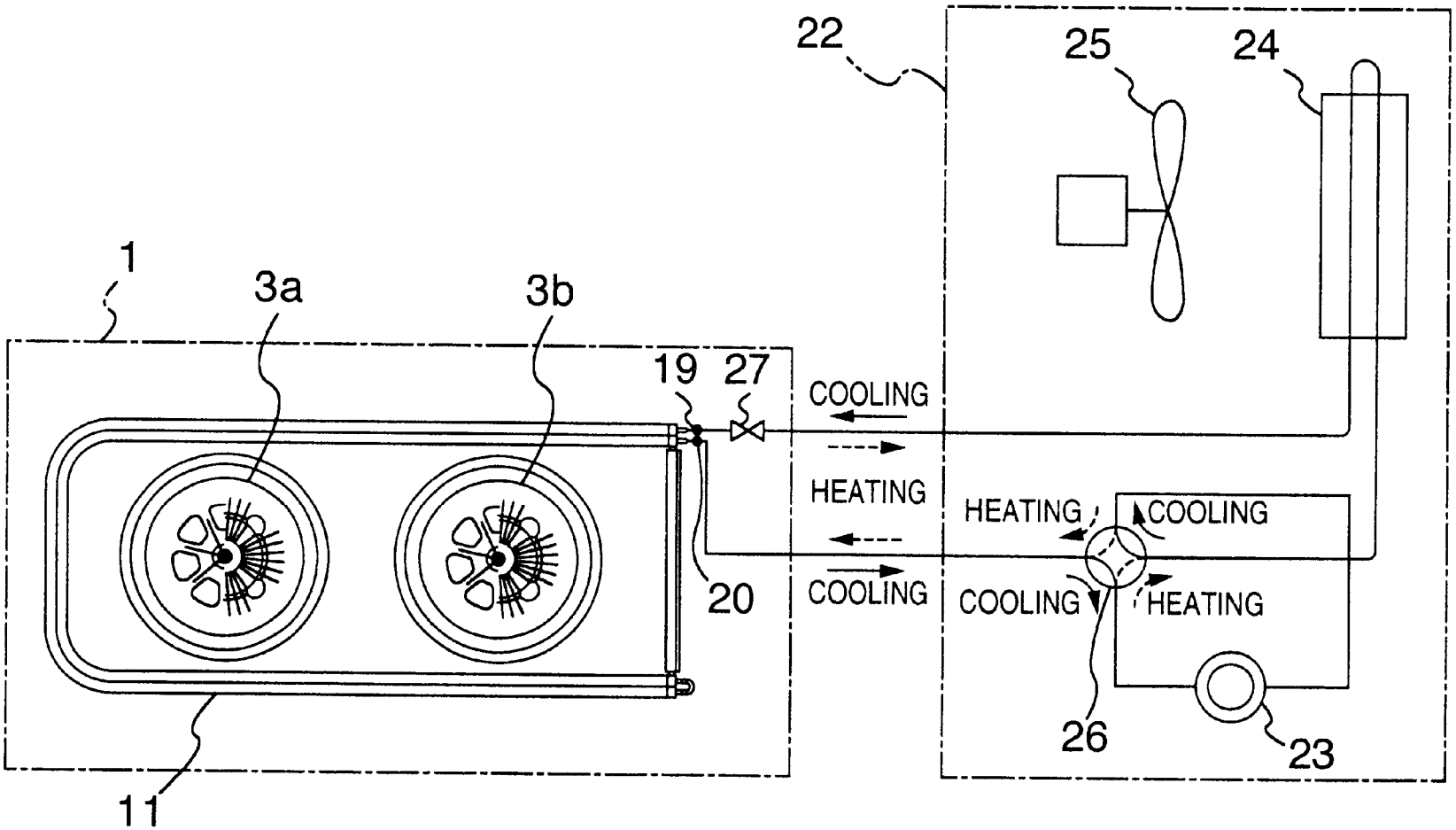
FIG. 14 is a schematic view of a representative refrigerant cycle system of an indoor unit and an outdoor unit separating type air conditioner.
Figure 15:
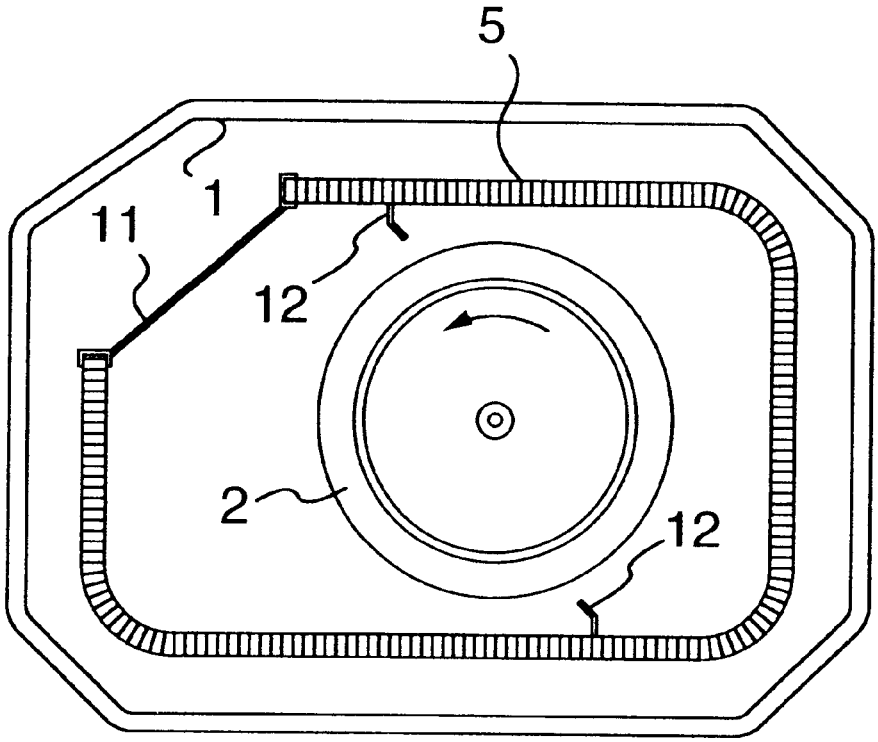
FIG. 15 is a horizontal cross sectional view of an air conditioner in accordance with the present invention.
Figure 16:
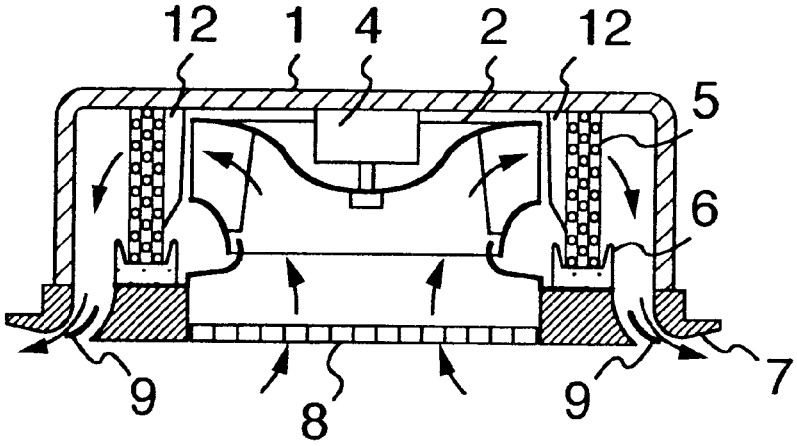
FIG. 16 is a vertical cross sectional view of an air conditioner in accordance with the present invention.
Figure 17:
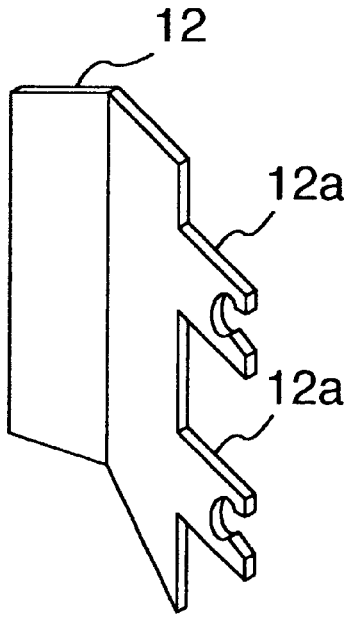
FIG. 17 is a perspective view of a rectifying plate used in the air conditioner shown in FIGS. 15 and 16.

FIG. 14 shows a schematic view of a representative refrigerant cycle system of an indoor unit and an outdoor unit separating type air conditioner in accordance with the present invention. The indoor unit is of the ceiling embedded type mentioned above, and comprises a pressure reducing apparatus 27, a refrigerant liquid temperature sensor 19 and a refrigerant gas sensor 20. An outdoor unit comprises a compressor 23, a four-way valve 26, an outdoor heat exchanger 24 and an outdoor unit fan 25 for blowing air to the outdoor heat exchanger, which are successively connected by pipes within the casing 22.

Upon cooling operation of the air conditioner, a high temperature and high pressure gas refrigerant which is compressed by the compressor 23 within the outdoor unit flows into the outdoor heat exchanger 24 via the four-way valve 26. Heat is dissipated to the air blown by the outdoor unit fan 25. The gas refrigerant is condensed and becomes a high temperature and high pressure liquid refrigerant. Then, it is reduced in pressure and expanded by the pressure reducing apparatus 27 such as an expansion valve, a capillary tube and the like within the indoor unit. The refrigerant becomes a gas and liquid two-phase refrigerant close to a low temperature and low pressure liquid in the phase changing area. The refrigerant flows into the indoor heat exchanger 11, and absorbs heat from the air blown by the indoor fans 3*a* and 3*b* to be evaporated. The refrigerant becomes a low temperature and low pressure gas refrigerant, and returns to the compressor 23 via the four-way valve 26. The refrigerant liquid temperature sensor 19 is provided in a pipe connecting the pressure reducing apparatus 27 with the indoor heat exchanger 11 in accordance with the needs for control. The refrigerant gas temperature sensor 20 is provided in an outlet pipe of the indoor heat exchanger 11 in accordance with the needs for control.

Upon heating operation, the four-way valve 23 is switched as shown by a broken line in the drawing, the refrigerant cycle is set to a reverse flow direction to that of the cooling operation, and the refrigerant is condensed in the indoor heat exchanger 11 and evaporated in the outdoor heat exchanger 24.

As mentioned above, according to the present invention, in a ceiling embedded type indoor unit comprising a casing embedded in a ceiling, a U-shaped heat exchanger placed within the casing, a plurality of blowers arranged side by side in an inner space of the heat exchanger, a plurality of motors for driving the blowers, a decorative panel mounted on a lower surface of the casing and having two elongated air outlet ports and an air suction port formed between the air outlet ports, and a control apparatus, the following structure provides the following advantages.

(1) By setting the number of rotation of the blowers disposed in the side of the valley portion of the U shape within the U-shaped heat exchanger, the side of which receives the wind on a lot of surfaces, to be high and the number of rotation of the blowers disposed in the side of the open end of the U shape, the side of which receives the wind on a little of surfaces, to be low, the wind velocity balance with respect to the heat exchanger becomes uniform, thereby preventing deterioration of the air conditioning capacity, worsening of the air noise and occurrence of the beat sound due to the interference of the numbers of rotation.

(2) In the case that it is required to switch the wind amount, the rotational number control apparatus is used in only one blower among a plurality of blowers and the other blowers are structured so as to have a fixed number of rotation, and therefore, it is possible to reduce a cost for the expensive rotational number control apparatus. Further, by controlling so that the blower having the variable number of rotation has the number of rotation to such a degree that the discharged air from the blower having the fixed number of rotation results a short circuit when making the wind amount of the blower having the variable number of rotation close to 0 at a time of the minimum wind amount, it is possible to prevent a useless work of the blower motor. Still further, by arranging the suction air temperature sensor near the blower of the fixed number of rotation, the suction air temperature sensor can detect an accurate temperature.

(3) Since the control is executed so that the numbers of rotation are changed while keeping the rate of the numbers of rotation of the blowers constant, it is possible to make the wind velocity balance with respect to the heat exchanger nearly uniform even in the case that the wind amount is required to be switched, thereby preventing worsening of the air conditioning performance and the blowing air noise. Further, by arranging the suction air temperature sensor near the blower of the high number of rotation, the suction air temperature sensor can detect an accurate temperature.

(4) Since the outlet air temperature is previously determined on the basis of the factors comprising the numbers of rotation of the respective blowers, the suction air temperature, the refrigerant liquid temperature and the refrigerant gas temperature which indicate the cycle operation state, and the outlet air temperature with respect to the detected values of the respective factors is indicated to the outlet air temperature sensor, it is possible to detect the temperature close to the average temperature of the outlet air.

(5) Since the blowers are vertically arranged at different levels, interference of the outlet air of the respective blowers can be restricted and it is possible to reduce the input and the noise of the blower motors.

(6) Further, according to the present invention, the ceiling embedded type indoor unit is structured such as to have the casing embedded in the ceiling, a plurality of blowers arranged in the longitudinal direction of the casing, and the C-shaped heat exchangers which surround most of the peripheries of the blowers. Therefore, the following advantages can be obtained. It is possible to make the peripheral lengths of the heat exchangers long, and the air discharged from the blowers collide with the heat exchangers at a uniform wind velocity, so that it is possible to increase the heat exchanging efficiency. Accordingly, it is possible to obtain more heat exchanging amount in the present invention in the case of the same size of the casing, so that it is possible to make the casing size compact.

FIGS. 15 to 19 show other embodiment in accordance with the present invention. Rectifying plate 12 bent in an L shape is formed with a mounting portion 12*a* for fixing the rectifying plate 12 to the pipe of the heat exchanger 5. The rectifying plates 12 are fixed to the pipe of the heat exchanger 5 via the mounting portions 12*a* so as to be positioned within areas A shown in FIG. 19.

In the structure mentioned above, when the impeller 2 is rotated, the air sucked from the suction port 8 is blown out from the outer periphery of the impeller in a tangential direction thereof. Then, in the downstream side of the air flow blown out from the position where the heat exchanger 5 and the impeller 2 are closest, the air flowing along the inner peripheral surface of the heat exchanger 5 is intercepted by the rectifying plates 12 and is introduced to the heat exchanger 5.

At this time, in the upstream sides of the rectifying plates 12, the flow velocity of the air blown out from the impeller 2 is lowered, so that it is possible to reduce the wind sound. Further, in the downstream sides of the rectifying plates 12, the air flow blown out from the impeller 2 moves over the rectifying plates 12 and collides with the heat exchanger 5. So, the direction of the wind is changed and it is possible to reduce the flow velocity so as to reduce the wind sound.

Accordingly, it is possible to reduce the wind sound and make the occurrence of noise of the whole of the air conditioner small.

Figure 18:
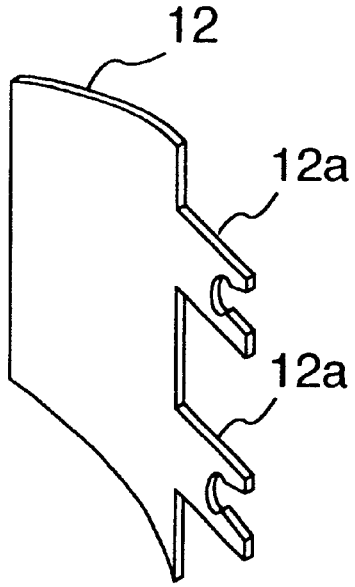
FIG. 18 is a perspective view showing another embodiment of the rectifying plate used in the air conditioner shown in FIGS. 15 and 16.
Figure 19:
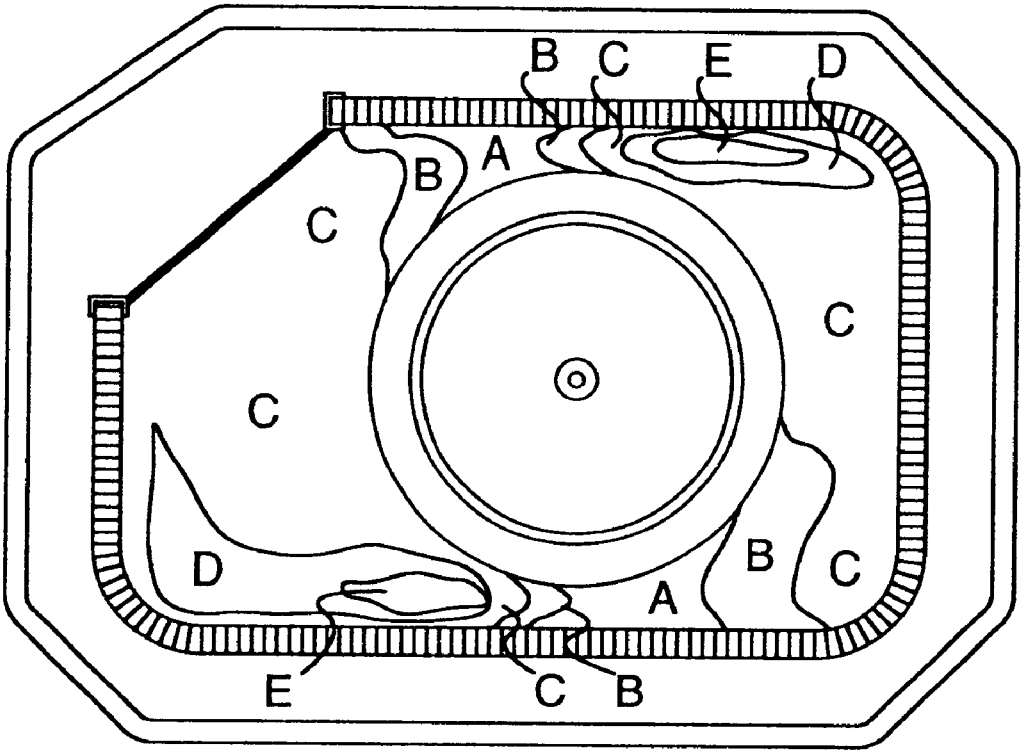
FIG. 19 is a plan view showing a wind velocity distribution of the air conditioner in accordance with the present invention.

FIG. 18 is a perspective view showing another embodiment of the rectifying plate. The rectifying plate 12 is structured such that a portion protruding to an inside of the heat exchanger is formed in a circular arc shape and is formed with the mounting portion 12*a* for fixing the rectifying plate 12 to the pipe of the heat exchanger 5.

In this case, the rectifying plate 12 is described with respect to the structure fixed to the pipe of the heat exchanger 5, however, the structure may be made such as to be inserted between radiating fins of the heat exchanger 5 so as to be held.

Further, the structure may be made such that a part of the rectifying plate 12, for example, a portion exposed to the wind is made of a metal, and the portion fixed to the pipe is made of a heat resisting synthetic resin.

Further, the rectifying plate 12 may be structured to be inclined so that the protruding amount from the heat exchanger 5 becomes smaller from the lower end of the outlet port of the impeller 2 toward a drain pan 6. In accordance with the structure mentioned above, it is possible to introduce a water drop condensed in the rectifying plate 12 along an inclined surface to the drain pan 6.

As mentioned above, since the structure is made such that the rectifying plate is provided in the downstream side of the position where the heat exchanger and the impeller are closest so as to reduce the flow velocity of the air blown out from the impeller and introduce the air to the heat exchanger, it is possible to reduce the wind sound generated in the heat exchanger even when the air conditioner is made into compact, so as to realize the lowering of noise of the air conditioner.

What is claimed is:

1. A ceiling embedded type indoor unit comprising:

a casing embedded in a ceiling;

a heat exchanger placed within said casing;

a plurality of blowers arranged side by side in a longitudinal direction of the casing for blowing air to said heat exchanger;

a plurality of motors each fixed to a ceiling side of the casing at upper end thereof and having a rotary shaft, said blowers being mounted at lower ends of the rotary shafts; and a decorative panel mounted to a lower surface of the casing and having two air outlet ports elongated in the longitudinal direction of the casing and parallel to each other and an air suction port formed between said air outlet ports, wherein the heat exchanger comprises C-shaped heat exchangers which surround most of peripheries of the blowers, and wherein a rectifying plate which protrudes inwardly from an inner peripheral surface of said heat exchanger so as to correspond to at least a height of an outlet of said impeller is provided in a downstream side of the air flow discharged from said impeller at a position at which the inner peripheral surface of said heat exchanger and an outer peripheral surface of said impeller are in the closest vicinity to each other.

2. A ceiling embedded type indoor unit comprising:

a casing embedded in a ceiling;

a heat exchanger placed within said casing;

a plurality of blowers arranged side by side in a longitudinal direction of the casing for blowing air to said heat exchanger;

a plurality of motors each fixed to a ceiling side of the casing at upper end thereof and having a rotary shaft, said blowers being mounted at lower ends of the rotary shafts; and a decorative panel mounted to a lower surface of the casing and having two air outlet ports elongated in the longitudinal direction of the casing and parallel to each other and an air suction port formed between said air outlet ports, wherein the heat exchanger comprises C-shaped heat exchangers which surround most of peripheries of the blowers, and wherein a rectifying plate which protrudes inwardly from an inner peripheral surface of said heat exchanger so as to correspond to at least a height of an outlet of said impeller and is inserted between radiating fins of said heat exchanger so as to be held is provided in a downstream side of the air flow discharged from said impeller at a position at which the inner peripheral surface of said heat exchanger and an outer peripheral surface of said impeller are in the closest vicinity to each other.

3. A ceiling embedded type indoor unit comprising:

a casing embedded in a ceiling;

a heat exchanger placed within said casing;

a plurality of blowers arranged side by side in a longitudinal direction of the casing for blowing air to said heat exchanger;

a plurality of motors each fixed to a ceiling side of the casing at upper end thereof and having a rotary shaft, said blowers being mounted at lower ends of the rotary shafts; and a decorative panel mounted to a lower surface of the casing and having two air outlet ports elongated in the longitudinal direction of the casing and parallel to each other and an air suction port formed between said air outlet ports, wherein the heat exchanger comprises C-shaped heat exchangers which surround most of peripheries of the blowers, and wherein a rectifying plate which protrudes inwardly from an inner peripheral surface of said heat exchanger so as to correspond to at least a height of an outlet of said impeller and is made of a heat resisting resin at least in a part thereof is provided in a downstream side of the air flow discharged from said impeller at a position at which the inner peripheral surface of said heat exchanger and an outer peripheral surface of said impeller are in the closest vicinity to each other.

4. A ceiling embedded type indoor unit comprising:

a casing embedded in a ceiling;

a heat exchanger placed within said casing;

a plurality of blowers arranged side by side in a longitudinal direction of the casing for blowing air to said heat exchanger;

a plurality of motors each fixed to a ceiling side of the casing at upper end thereof and having a rotary shaft, said blowers being mounted at lower ends of the rotary shafts; and a decorative panel mounted to a lower surface of the casing and having two air outlet ports elongated in the longitudinal direction of the casing and parallel to each other and an air suction port formed between said air outlet ports, wherein the heat exchanger comprises C-shaped heat exchangers which surround most of peripheries of the blowers, and wherein a rectifying plate which protrudes inwardly from an inner peripheral surface of said heat exchanger so as to correspond to at least a height of an outlet of said impeller and is structured such that a protruding amount becomes smaller from the ceiling side of said casing toward the suction port side is provided in a downstream side of the air flow discharged from said impeller at a position at which the inner peripheral surface of said heat exchanger and an outer peripheral surface of said impeller are in the closest vicinity to each other.

* * * * *